US007573202B2

(12) United States Patent
Eden et al.

(10) Patent No.: US 7,573,202 B2
(45) Date of Patent: Aug. 11, 2009

(54) METAL/DIELECTRIC MULTILAYER MICRODISCHARGE DEVICES AND ARRAYS

(75) Inventors: J. Gary Eden, Mahomet, IL (US); Sung-Jin Park, Champaign, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 606 days.

(21) Appl. No.: 10/958,175

(22) Filed: Oct. 4, 2004

(65) Prior Publication Data

US 2006/0082319 A1 Apr. 20, 2006

(51) Int. Cl.
*H01J 17/04* (2006.01)
*H01J 61/04* (2006.01)

(52) U.S. Cl. ..... 313/631; 313/306; 313/586

(58) Field of Classification Search ..... 313/631, 313/306, 356, 586, 618
See application file for complete search history.

(56) References Cited

U.S. PATENT DOCUMENTS 3,487,254 A 12/1969 Vollmer
3,697,797 A 10/1972 Freyheit et al.
3,793,552 A 2/1974 Glascock et al.
3,908,147 A 9/1975 Hall et al.
3,970,887 A 7/1976 Smith et al.
4,060,748 A 11/1977 Bayless
4,367,554 A 1/1983 Schlossberg
4,370,797 A 2/1983 van Gorkom et al.
4,459,636 A 7/1984 Meister et al.
4,475,060 A 10/1984 Aboelfotoh
4,638,218 A 1/1987 Shinoda
4,672,624 A 6/1987 Ford
4,698,546 A 10/1987 Maitland et al.
4,720,706 A 1/1988 Stine
4,724,356 A 2/1988 Daehler
4,728,864 A 3/1988 Dick
4,803,402 A 2/1989 Raber et al.
4,808,883 A 2/1989 Iwaya et al.

(Continued)

FOREIGN PATENT DOCUMENTS

JP 7192701 7/1995

(Continued)

OTHER PUBLICATIONS

A.. El-Habachi, et al., Sep. 15, 2000, "Series operation of direct current xenon chloride excimer sources," Journal of Applied Physics, vol. 88, No. 6, pp. 3220-3224.

(Continued)

*Primary Examiner*—Toan Ton
*Assistant Examiner*—Kevin Quarterman
(74) *Attorney, Agent, or Firm*—Greer, Burns & Crain, Ltd.

(57) ABSTRACT

A microdischarge device that includes one or more electrodes encapsulated in a nanoporous dielectric. The devices include a first electrode encapsulated in the nanoporous dielectric and a second electrode that may also be encapsulated with the dielectric. The electrodes are configured to ignite a microdischarge in a microcavity when an AC or a pulsed DC excitation potential is applied between the first and second electrodes. The devices include linear and planar arrays of microdischarge devices. The microcavities in the planar arrays may be selectively excited for display applications.

22 Claims, 8 Drawing Sheets

U.S. PATENT DOCUMENTS 4,843,281 A 6/1989 Mendelsohn
4,858,062 A 8/1989 Hayakawa et al.
4,890,031 A 12/1989 Zwier
4,956,577 A 9/1990 Parker
4,988,918 A 1/1991 Mori et al.
4,992,703 A 2/1991 Ramaiah
5,013,902 A 5/1991 Allard
5,055,979 A 10/1991 Boland et al.
5,062,116 A 10/1991 Christensen
5,132,811 A 7/1992 Iwaki et al.
5,144,527 A 9/1992 Amano et al.
5,164,633 A 11/1992 Kim et al.
5,200,973 A 4/1993 Ford
5,387,805 A 2/1995 Metzler et al.
5,438,343 A 8/1995 Khan et al.
5,496,199 A 3/1996 Makishima et al.
5,514,847 A 5/1996 Makishima et al.
5,626,772 A 5/1997 Bongaerts et al.
5,686,789 A 11/1997 Schoenbach et al.
5,691,608 A 11/1997 Yamamoto et al.
5,723,945 A 3/1998 Schermerhorn
5,926,496 A 7/1999 Ho et al.
5,939,829 A 8/1999 Schoenbach et al.
5,955,828 A 9/1999 Sadwick et al.
5,969,378 A 10/1999 Singh
5,984,747 A 11/1999 Bhagavatula et al.
5,986,409 A 11/1999 Farnworth et al.
5,990,620 A 11/1999 Lepselter
6,016,027 A 1/2000 DeTemple et al.
6,043,604 A 3/2000 Horiuchi et al.
6,051,923 A 4/2000 Pong
6,072,273 A 6/2000 Schoenbach et al.
6,082,294 A 7/2000 Simpson
6,097,145 A 8/2000 Kastalsky et al.
6,139,384 A 10/2000 DeTemple et al.
6,147,349 A 11/2000 Ray
6,194,833 B1 2/2001 DeTemple et al.
6,217,833 B1 4/2001 Kolu
6,239,547 B1 5/2001 Uemura et al.
6,333,598 B1 12/2001 Eden et al.
6,346,770 B1 2/2002 Schoenbach et al.
6,353,289 B1 3/2002 Ishigami et al.
6,433,480 B1 8/2002 Stark et al.
6,448,946 B1 * 9/2002 Anderson et al. ..... 345/60
6,456,007 B1 9/2002 Ryu et al.
6,459,201 B1 10/2002 Schermerhorn et al.
6,538,367 B1 3/2003 Choi et al.
6,541,915 B2 4/2003 Eden et al.
6,548,962 B1 4/2003 Shiokawa et al.
6,563,257 B2 5/2003 Vojak et al.
6,597,120 B1 7/2003 Schemerhorn et al.
6,626,720 B1 9/2003 Howard et al.
6,657,370 B1 12/2003 Geusic
6,695,664 B2 2/2004 Eden et al.
6,815,891 B2 11/2004 Eden et al.
6,825,606 B2 11/2004 Schermerhorn et al.
6,828,730 B2 12/2004 Eden et al.
6,867,548 B2 3/2005 Eden et al.
7,026,640 B2 4/2006 Nathan et al.
7,112,918 B2 9/2006 Eden et al.
7,126,266 B2 10/2006 Park et al.
2002/0030437 A1 * 3/2002 Shimizu et al. ..... 313/495
2002/0036461 A1 3/2002 Schoenbach et al.
2003/0030374 A1 * 2/2003 Pai ..... 313/582
2003/0080688 A1 * 5/2003 Eden et al. ..... 315/169.3
2003/0132693 A1 7/2003 Eden et al.
2003/0230983 A1 12/2003 Vonallmen
2004/0100194 A1 5/2004 Eden et al.
2004/0144733 A1 * 7/2004 Cooper et al. ..... 210/748
2004/0160162 A1 8/2004 Eden et al.
2005/0142035 A1 * 6/2005 Bonne et al. ..... 422/82.05
2005/0148270 A1 7/2005 Eden et al.
2005/0269953 A1 12/2005 Eden et al.
2006/0038490 A1 2/2006 Eden et al.
2006/0071598 A1 4/2006 Eden et al.
2006/0084262 A1 4/2006 Qin
2006/0196424 A1 * 9/2006 Swallow et al. ..... 118/723 E
2007/0017636 A1 * 1/2007 Goto et al. ..... 156/345.47
2007/0108910 A1 5/2007 Eden et al.
2007/0170866 A1 7/2007 Eden

FOREIGN PATENT DOCUMENTS

JP 2004099400 A * 4/2004

OTHER PUBLICATIONS

K. H. Schoenbach, et al, Jan. 1996., "Microhollow cathode discharges," Appl. Phys. Lett., vol. 68, No. 1, pp. 13-15.
L. D. Biborosch, et al, Dec. 20, 1999, "Microdischarges with plane cathodes," Appl. Phys. Lett., vol. 75, No. 25, Dec. 20, 1999, pp. 3926-3928.
S. J. Park, et al, Jul. 10, 2000, "Flexible microdischarge arrays: Metal/polymer devices", Applied Physics Letters, vol. 77, No. 2, pp. 199-201.
J.W. Frame et al., Sep. 1997, "Microdischarge devices fabricated in silicon", Applied Physics Letters, vol. 71, No. 9, pp. 1165-1167.
J.W. Frame,et al., May 25, 1998, "Continuous-wave emission in the ultraviolet from diatomic excimers in a microdischarge", Applied Physics Letters, vol. 72, No. 21, pp. 2634-2636.
J.W. Frame et al., Jul. 23, 1998, "Planar microdischarge arrays", Electronics Letters, vol. 34, No. 15, pp. 1529-1531.
Karl H. Schoenbach et al, Jun. 30, 1997, "High-pressure hollow cathode discharges;"; Plasma Sources Sci Technical., pp. 468-477.
A. El-Habachi, et al, Jan. 5, 1998, "Emission of excimer radiation from direct current, high-pressure hollow cathode discharges;"; App. Phys. Lett. 72(1), pp. 22-24.
S. J. Park et al., Jan. 2001, "Performance of microdischarge devices and arrays with screen electrodes," IEEE Photon, Tech. Lett., vol. 13, pp. 61-63.
C. J. Wagner, et al., Feb. 12, 2001 "Excitation of a microdischarge with a reverse-biased pn junction," Appl. Phys. Lett., vol. 78, pp. 709-711.
S. J. Park et al., Sep. 24, 2001, "Independently addressable subarrays of silicon microdischarge devices: Electrical characteristics of large (30 x 30) arrays and excitation of a phosphor," Appl. Phys. Lett., vol. 79, pp. 2100-2102.
B.A.Voyak, et al., Mar. 5, 2001, "Multistage, monolithic ceramic microdischarge device having an active length of -0.27 mm," Appl. Phys. Lett., vol. 78, No. 10, pp. 1340-1342.
R. H. Stark et. al., Feb. 15, 1999, "Direct current high-pressure glow discharges", J. Appl. Phys. vol. 85, pp. 2075-2080.
J.F. Waymouth, Dec. 1991, "LTE and Near-LTE Lighting Plasmas" , IEEE Transaction on Plasma Science, Vo. 19 No. 6 pp. 1003-1012.
A.D. White, May 1959, "New Hollow Cathode Glow Discharge", Journal of Applied Physics, vol. 30, No. 5, pp. 711-719.
L.C. Pitchford, et al., Jul. 1997, "The breakdown and glow phases during the initiation of discharges for lamps", J. Appl. Phys. 82, (1) pp. 112-119.
S. J.Park et al., Feb. 1, 2001, "Arrays of microdischarge devices having 50-100um square pyramidal Si anodes and screen cathodes," 1 Electron. Lett. . vol. 37 No. 3, pp. 171-172.
J.G. Eden et al., Nov. 2003, "Microplasma devices fabricated in silicon, ceramic, and metal/polymer structures: arrays, emitters and photodetectors," Journal of Physics *D: Applied Physics* 36, p. 2869-2877.
S. J. Park et al., May 31, 2004, "Carbon nanotube-enhanced performance of microplasma devices," Applied Physics Letters, pp. 4481-4483, vol. 84, No. 22.
H. Masuda; et al., Jun. 9, 1995, "Ordered Metal Nanohole Arrays Made by a Two-Step Replication of Honeycomb Structures of Anodic Alumina", Science, New Series, vol. 268, No. 5216, 1466-1468.
O. Jessensky et al., Mar. 9, 1998, "Self-organized formation of hexagonal pore arrays in anodic alumina", Applied Physics Letters, vol. 72 No. 10., 1173-1175.

R. H. Stark et al., Jun. 21, 1999, "Direct current glow discharges in atmospheric air," Appl. Phys. Lett., vol. 74, pp. 3770-3772.

S.-J. Park et al., Jan. 22, 2001, "Silicon microdischarge devices having inverted pyramidal cathodes: Fabrication and performance of arrays," Appl. Phys. Lett., vol. 78, pp. 419-421.

A.-A. H. Mohamed, et al., Feb. 2002, "Direct current glow discharges in atmospheric air," IEEE Trans. Plasma Sci., vol. 30, pp. 182-183.

U.S. Appl. No. 11/042,288, filed Jul. 2007, Eden.

J.J. Chiu, C.C. Kei, T.P. Perng, W.S. Wang, "Organic Semiconductor Nanowires for Field Emission", Advanced Materials, vol. 15, No. 16, Aug. 15, 2003, pp. 1361-1364.

J. Katz, S. Margalit, A. Yariv, "Diffraction Coupled Phase-Locked Semiconductor Laser Array", Appl. Phys. Lett., vol. 42, No. 7, Apr. 1, 1983, pp. 554-556.

C.J. Lee, T.J. Lee, S.C. Lyu, Y. Zhang, H.Ruh, H.J. Lee, "Field Emission from Well-Aligned Zinc Oxide Nanowires Grown at Low Temperature", Applied Physics Letters, vol. 81, No. 19, Nov. 4, 2002, pp. 3648-3650.

Y.H. Lee, C.H. Choi, Y.T. Jang, E.K. Kim, B.K. Ju, N.K. Min, J.H. Ahn, "Tungsten Nanowires and Their Field Electron Emission Properties", Applied Physics Letters, vol. 81, No. 4, Jul. 22, 2002, pp. 745-747.

L.A. Newman, R.A. Hart, J.T. Kennedy, A.J. Cantor, A.J. DeMaria, "High Power Coupled $CO_2$ Waveguide Laser Array", Appl. Phys. Lett., vol. 48, No. 25, Jun. 23, 1986, pp. 1701-1703.

M. Oka, H. Masuda, Y. Kaneda, S. Kubota, "Laser-Diode-Pumped Phase-Locked Nd:YAG Laser Arrays", IEEE Journal of Quantum Electronics, vol. 28, No. 4, Apr. 1992, pp. 1142-1147.

S.J. Park, K.H. Park, J.G. Eden, "Integration of Carbon Nanotubes with Microplasma Device Cathodes: Reduction in Operating and Ignition Voltages", Electronics Letters, vol. 40, No. 9, Apr. 29, 2004.

S.J. Park, J.G. Eden, "Stable Microplasmas in Air Generated with a Silicon Inverted Pyramid Plasma Cathode," IEEE Transactions on Plasma Science, vol. 33, No. 2, Apr. 2005, pp. 570-571.

J.E. Ripper. T.L. Paoli, "Optical Coupling of Adjacent Stripe-Geometry Junction Lasers", Applied Physics Letters, vol. 17, No. 9, Nov. 1, 1970, pp. 371-373.

C. Tang, Y. Bando, "Effect of BN Coatings on Oxidation Resistance and Field Emission of SiC Nanowires", Applied Physics Letters, vol. 83, No. 4, Jul. 28, 2003, pp. 659-661.

Z.S. Wu, S.Z. Deng, N.S. Xu, J. Chen, J. Zhou, J. Chen, "Needle-Shaped Silicon Carbide Nanowires: Synthesis and Field Electron Emission Properties", vol. 80, No. 20, May 20, 2002, pp. 3829-3831.

D.G. Youmans, "Phase Locking of Adjacent Channel Leaky Waveguide $CO_2$ Lasers", Applied Physics Lett. 44, vol. 4, Feb. 15, 1984, pp. 365-367.

J. Zhou, N.S. Xu, S.Z. Deng, J. Chen, J.C. She, Z.L. Wang, "Large-Area Nanowire Arrays of Molybdenum and Molybdenum Oxides: Synthesis and Field Emission Properties", Advanced Materials, vol. 15, No. 21, Nov. 4, 2003, pp. 1835-1840. cited by other.

* cited by examiner

METAL/DIELECTRIC MULTILAYER MICRODISCHARGE DEVICES AND ARRAYS

STATEMENT OF GOVERNMENT INTEREST

This invention was made with Government assistance under U.S. Air Force Office of Scientific Research grant Nos. F49620-00-1-0391 and F49620-03-1-0391. The Government has certain rights in this invention.

TECHNICAL FIELD

The present invention relates to microdischarge devices and, in particular, to microdischarge devices and arrays including nanoporous dielectric-encapsulated electrodes.

BACKGROUND

Microplasma (microdischarge) devices have been under development for almost a decade and devices having microcavities as small as 10 μm have been fabricated. Arrays of microplasma devices as large as $4*10^4$ pixels in ~4 $cm^2$ of chip area, for a packing density of $10^4$ pixels per $cm^2$, have been fabricated. Furthermore, applications of these devices in areas as diverse as photodetection in the visible and ultraviolet, environmental sensing, and plasma etching of semiconductors have been demonstrated and several are currently being explored for commercial potential. Many of the microplasma devices reported to date have been driven by DC voltages and have incorporated dielectric films of essentially homogeneous materials.

Regardless of the application envisioned for microplasma devices, the success of this technology will hinge on several factors, of which the most important are manufacturing cost, lifetime, and radiant efficiency. A method of device fabrication that addresses at least the first two of these factors is, therefore, highly desirable.

SUMMARY OF THE INVENTION

In a first embodiment of the invention, a microdischarge device is provided that includes a first electrode encapsulated in a dielectric, which may be a nanoporous dielectric film. A second electrode is provided which may also be encapsulated with a dielectric. The electrodes are configured to ignite a discharge in a microcavity when a time-varying (an AC, RF, bipolar or a pulsed DC, etc.) potential is applied between the electrodes. In specific embodiments of the invention, the second electrode may be a screen covering the microcavity opening and the microcavity may be closed at one end. In some embodiments of the invention, the second electrode may be in direct contact with the first electrode. In other embodiments, a gap separates the electrodes.

In another embodiment of the invention, a microdischarge device array is provided. The array includes a plurality of electrode pairs. Each electrode pair includes a first electrode and a second electrode with each electrode comprising a metal encapsulated with a dielectric. Each pair of electrodes is configured to ignite a discharge in a corresponding microcavity when a time-varying potential is applied between the electrodes. In a specific embodiment of the invention, the electrode pairs are stacked, forming a linear array of microdischarge devices.

In a further embodiment of the invention, a microdischarge device array is provided that includes a planar electrode array including a plurality of metal electrodes encapsulated in a dielectric. The encapsulated electrode array forms a plurality of microcavities. A common electrode is configured to ignite a discharge in each microcavity when a potential is applied between the common electrode and the electrode array. In some embodiments, the common electrode is transparent to the light emitted by the array.

In another embodiment of the invention, a microdischarge device array for display applications is provided. The array includes a first electrode comprising a metal encapsulated with a first dielectric; a plurality of microcavities associated with the first electrode; a second electrode comprising a metal encapsulated with a second dielectric; and a plurality of microcavities associated with the second electrode. The first electrode and the second electrode are configured to ignite a microdischarge in a given microcavity when a potential is applied between the first and second electrode but only if the given microcavity is a member of both the first plurality of microcavities and the second plurality of microcavities.

In another embodiment of the invention, a cylindrical microdischarge device array is provided that includes a metal cylinder (tube). A plurality of microcavities is formed on the inner surface of the cylinder which is then encapsulated with a dielectric. An electrode is disposed along the center axis of the cylinder and the electrode is configured to ignite a discharge in each microcavity when a time-varying potential is applied between the electrode and the cylinder. Toxic gas remediation may be effected by introducing a flow of gas along the center electrode. A potential is applied between the center electrode and the cylinder to ignite a discharge in each microcavity. The discharges dissociate the impurities in the gas as the gas flows through the microcavities. In other embodiments of the invention, this structure may be used for photochemical treatment of gases flowing through the cylinder. It may also serve as a gain medium for a laser.

Embodiments of the invention introduce microdischarge device array geometries and structures for the purpose of scaling the active length and/or area that is required for applications in medicine and photopolymerization (photoprocessing of materials), for example.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

The present invention may advantageously employ nanoporous dielectrics such as those described in U.S. patent application Ser. No. 10/958,174, filed on even date herewith, entitled "Microdischarge Devices with Encapsulated Electrodes" which is incorporated herein by reference.

Figure 1A:
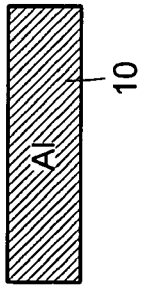
FIGS. 1A-1F show a diagram of a process for fabricating nanoporous encapsulated metal microplasma electrodes.
Figure 1B:
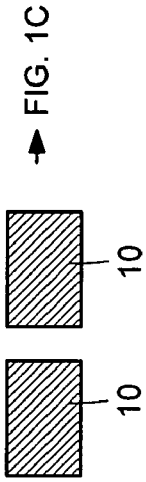
Figure 1C:
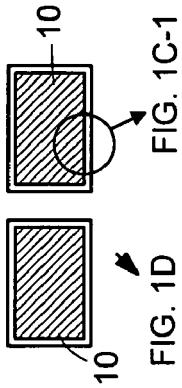
Figures 1, 1C:
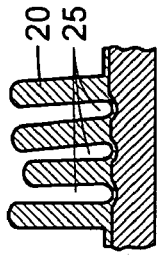
Figure 1D:
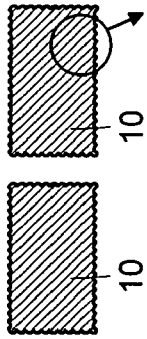
Figures 1, 1D:
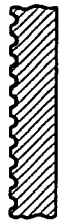
Figure 1E:
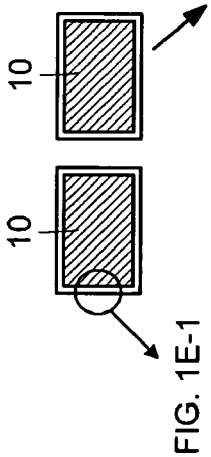
Figure 1F:
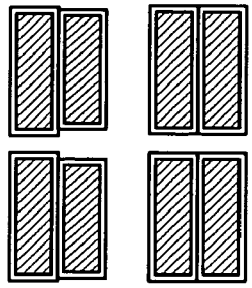
Figures 1, 1E:
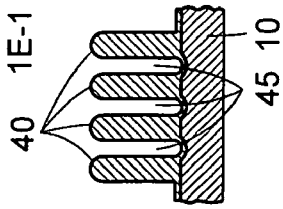

FIGS. 1A-1F illustrate a process for growing a dielectric on an exemplary metal, in this case aluminum, to produce an electrode. A dielectric layer 20 of $Al_2O_3$ can be grown on an aluminum substrate in any form including, but not limited to: thin films, foils, plates, rods or tubes. The process is initiated by cleaning the Al substrate (FIG. 1A) and subsequently producing a microcavity of the desired cross-sectional shape size and depth (the cavity need not extend through the entire substrate) by a variety of processes which are known in the art (FIG. 1B). Subsequently, the Al substrate 10 is anodized (FIG. 1C) which yields a nanoporous surface 20 of $Al_2O_3$ with columnar voids 25, but this surface may be irregular as shown. Removing the nanocolumns 20 by dissolution yields the "template" structure shown in FIG. 1D. Anodizing the structure a second time results in the very regular structure of columnar voids 45 between columns of dielectric 40 shown in FIG. 1E. The thickness of this dielectric material 40 can be varied from hundreds of nanometers ("nm") to hundreds of microns. Furthermore, the diameter of the columnar voids 45 in the dielectric can be adjusted from tens to hundreds of nm. This electrode structure may be used advantageously for microplasma discharge devices. In this specification and in any appended claims, the term "nanoporous dielectric" shall mean a dielectric substantially similar to the dielectric with regular voids created by the process illustrated in FIGS. 1A to 1E. The term will include dielectric structures that are further processed such as by backfilling the nanopores with, for example, dielectrics, metals or carbon nanotubes.

In various embodiments of the invention, microdischarge devices are provided that include one or more electrodes encapsulated in a nanoporous dielectric. The nanoporous dielectric may be formed, for example without limitation, by a wet chemical process, as described above. Thus, a variety of device structures may be fabricated economically. These devices include a first electrode encapsulated in the dielectric and a second electrode that may also be encapsulated with the dielectric of the first electrode or another dielectric. The electrodes are configured to ignite a microdischarge in a microcavity (i.e., a cavity having a characteristic dimension (diameter, length of a rectangle, etc.) approximately 500 μm or less) when a time-varying (AC, pulsed DC, etc.) excitation potential is applied between the first and second electrodes. The encapsulated electrodes are not exposed to the microplasma discharge, facilitating a longer electrode life.

Figure 2A:
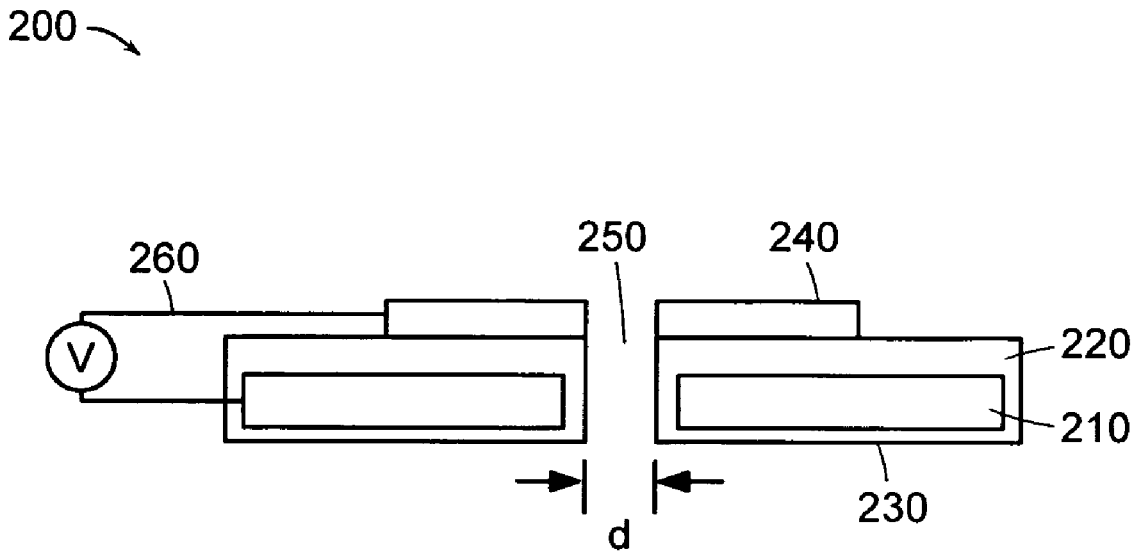
FIG. 2A shows a microdischarge device with an encapsulated electrode in cross-section according to an embodiment of the present invention.
Figure 2B:
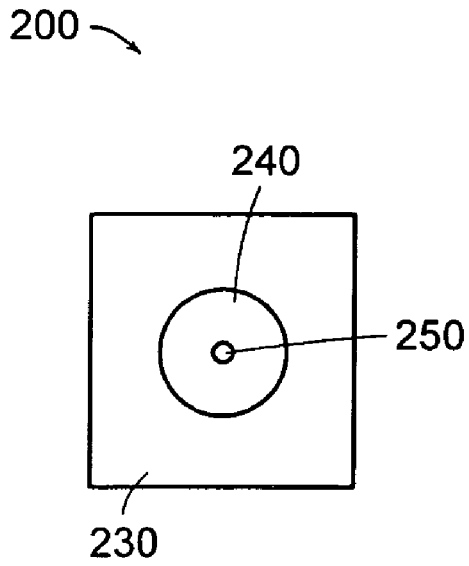
FIG. 2B shows a top view of the device of FIG. 2A.

A microdischarge device 200 is shown in cross-section in FIG. 2A, according to a first embodiment of the invention. A first electrode 230 is formed from a metal 210, such as aluminum, encapsulated with a dielectric 220. The dielectric may be a nanoporous dielectric, such as $Al_2O_3$. A second electrode 240 is placed adjacent to the first electrode and a microcavity 250 of diameter "d" is formed by one of a variety of well-known processes such as microdrilling, laser machining, chemical etching, etc. The microcavity extends through electrode 240 but does not necessarily extend completely through electrode 230. The diameter d typically may be on the order of 1 to 500 microns. Furthermore, the cavity cross-section need not be circular, but can assume a variety of shapes. The second electrode can be any conducting material including metals, indium tin oxide ("ITO"), doped crystalline or polycrystalline semiconductors or even a polymer. An alternating-current ("AC") or other time-varying voltage 260 applied between the first electrode and the second electrode will ignite a microplasma in the microcavity 250 if a discharge gas or vapor of the proper pressure is present and the peak voltage is sufficient. FIG. 2B shows a top view of the device 200. While the microcavity 250 shown is a cylinder, such microcavities are not limited to cylinders and other shapes and aspect ratios are possible. The metal 210 in the first electrode advantageously does not come in contact with the microplasma, facilitating a longer electrode life.

Figure 3A:
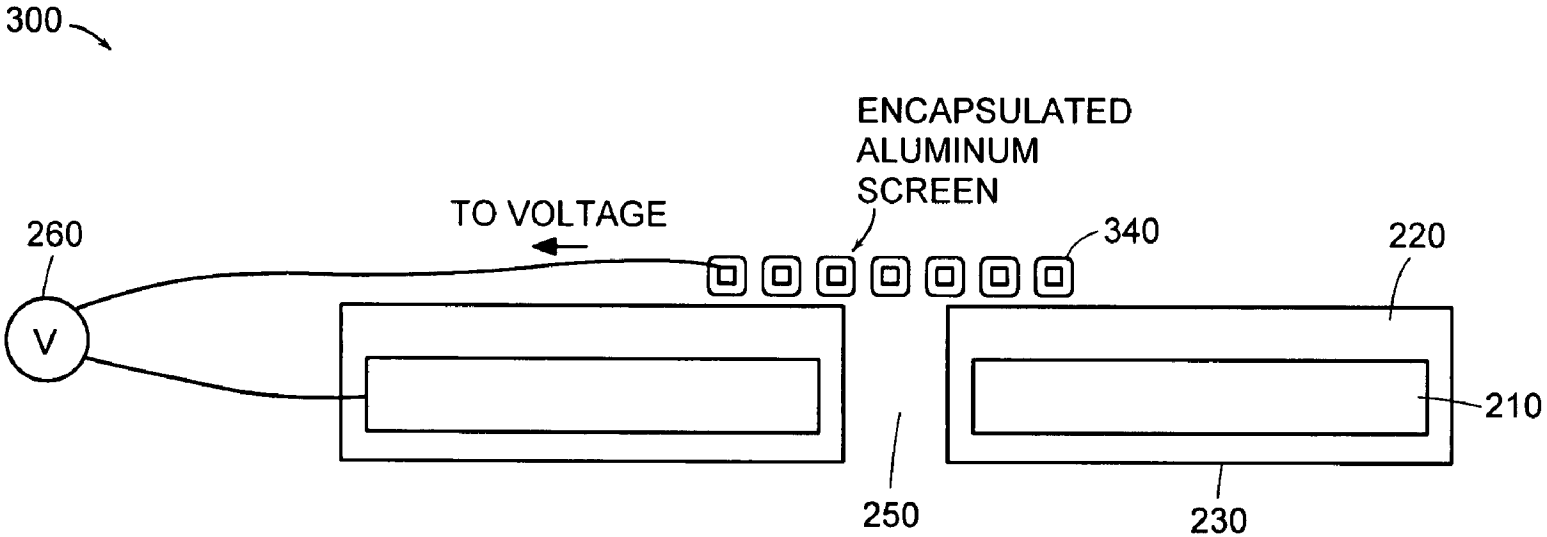
FIG. 3A shows a microdischarge device in cross-section with an encapsulated electrode and an encapsulated metal screen for the other electrode, according to an embodiment of the present invention.
Figure 3B:
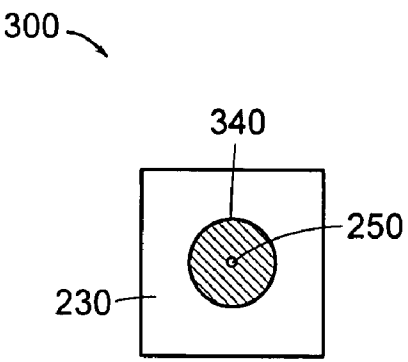
FIG. 3B shows a top view of the device of FIG. 3A.

In another related embodiment of the invention 300, as shown in cross-section in FIG. 3A, the second electrode may be a metal screen 340 that covers, at least partially, the microcavity 250. The screen electrode may also be encapsulated with a nanoporous dielectric (as shown) if the metal is chosen properly (e.g., Al, W Zr, etc.). FIG. 3B shows a top-down (plan) view of the device.

Figure 4:
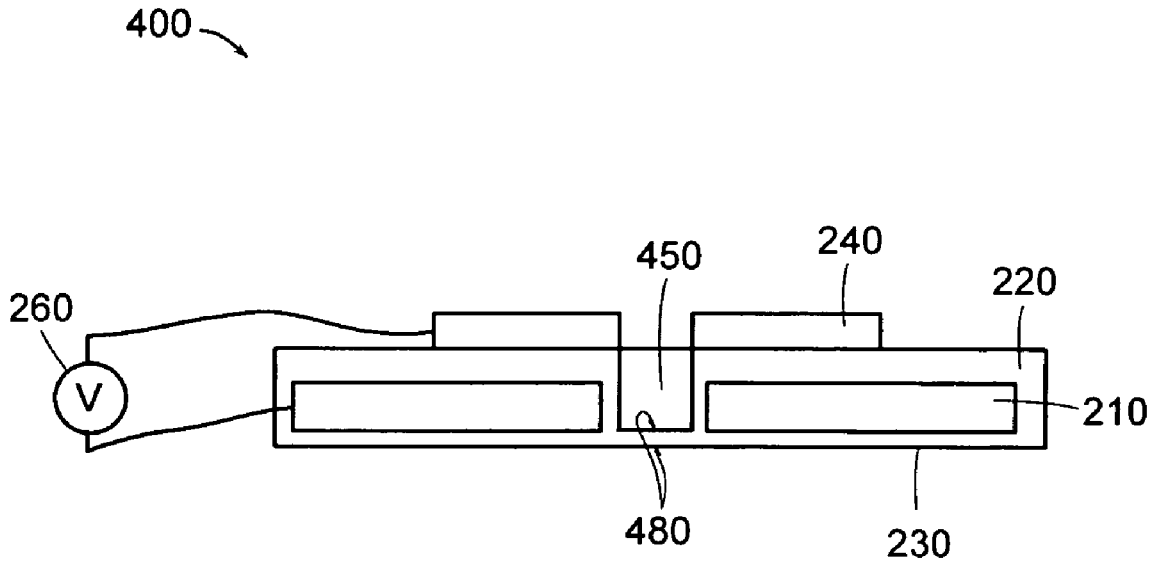
FIG. 4 shows a microdischarge device in cross-section where the microcavity is closed at one end, according to an embodiment of the present invention.

In a further related embodiment 400 of the invention, as shown in cross-section in FIG. 4, one end 480 of the microcavity discharge channel 450 is closed. The dielectric "cap" 480 can serve to reflect light of specified wavelengths by designing a photonic band gap structure into the dielectric 220 or the dielectric 220 at the base of the microcavity 450 can be coated with one or more reflective materials. If the dielectric is transparent in the spectral region of interest, the reflective layers 480 may be applied to the outside of the dielectric 220.

Figure 5:
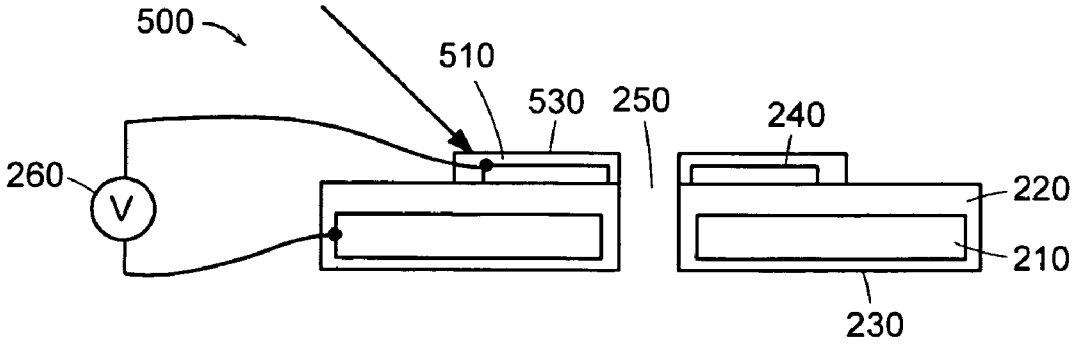
FIG. 5 shows a device similar to the device of FIG. 2 where both electrodes are encapsulated.
Figure 6:
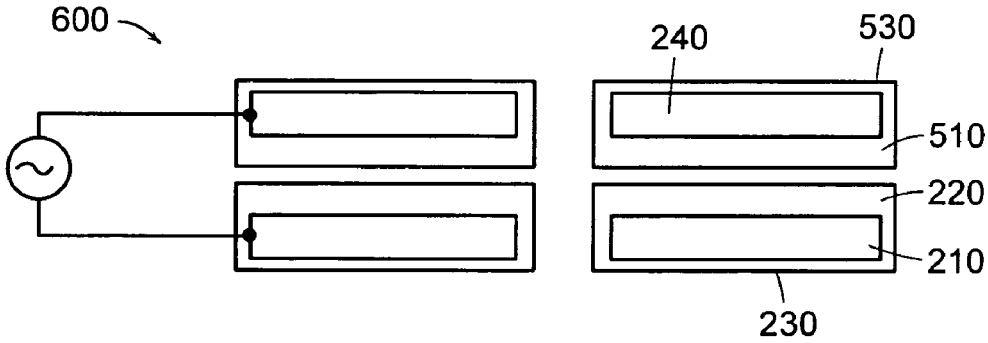
FIG. 6 shows a stacked version of the device of FIG. 5 where the two electrodes are not in direct physical contact.
Figure 7:
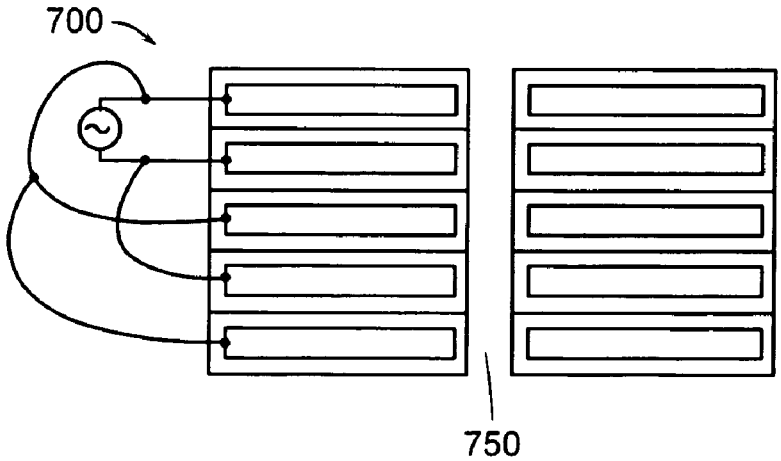
FIG. 7 shows a stacked version of the device of FIG. 5 forming a linear array in which the electrode pairs are in direct physical contact, according to an embodiment of the invention.

In other embodiments of the invention, both electrodes of the microdischarge device may be encapsulated with a dielectric. FIG. 5 shows a device 500 with a structure similar to the device of FIG. 2, except that the second metal electrode 240 is encapsulated with a dielectric 510 forming a second encapsulated electrode 530. In FIG. 5, electrode 230 and electrode 530 are in direct physical contact. In other embodiments of the invention, such as that shown in FIG. 6, microdischarge devices 600 may be formed where the electrode pairs 230, 530 are stacked with a gap between the dielectric layers for adjacent electrodes. The number of electrode pairs that may be stacked is a matter of design choice and linear arrays 700 of microplasmas having an extended length may be achieved, as illustrated in FIG. 7. Such stacked devices can advantageously provide increased intensity of light emission and are suitable for realizing a laser by placing mirrors at either end of the microchannel 750. Alternatively, the structure of FIG. 7 may be used in other applications in which a plasma column of extended length is valuable.

Figure 8:
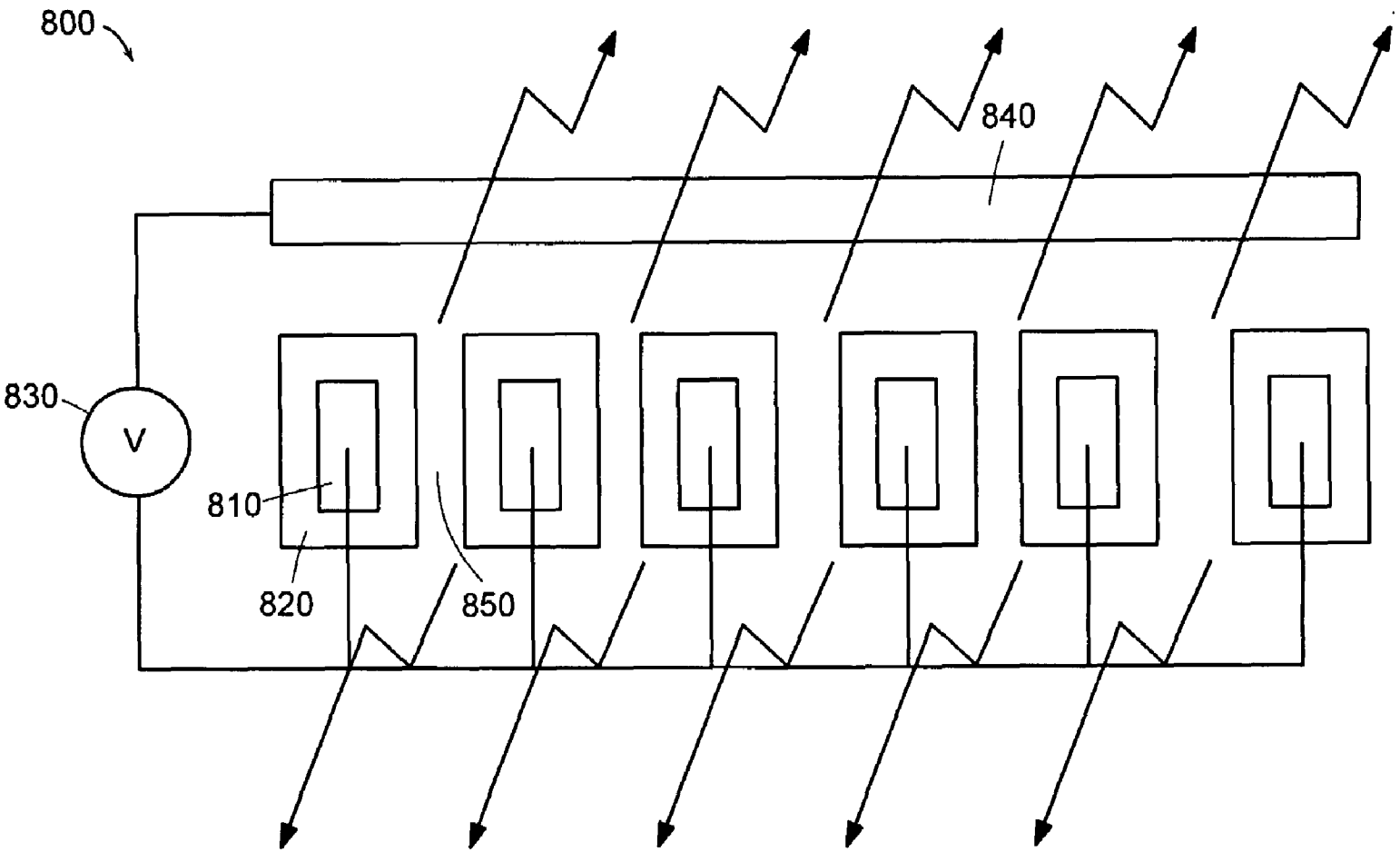
FIG. 8 shows a microdischarge structure where microcavities form a planar array according to an embodiment of the invention.

In another embodiment of the invention, as shown in cross-section in FIG. 8, a microplasma device array with a planar geometry 800 is formed. In this embodiment, a metal electrode array 810 defining the individual "pixel" size is encapsulated in a dielectric 820. The electrode array 810 can be economically fabricated by laser micromachining in a metal substrate or, alternatively, by wet or plasma etching. Once the electrode array is formed, the dielectric 820 can be deposited over the entire array by a wet chemical process. All of the pixels in the array may share a common transparent electrode 840, such as ITO on glass, quartz or sapphire. Applying a potential 830 between the electrodes ignites discharges in the microcavities 850. Light emitted from the microdischarges can escape through the common electrode 840 or out the other end of the microcavities 850. Alternatively, the common electrode 840 need not be transparent but can be a dielectric-encapsulated metal electrode as described earlier. Light can then be extracted out of the end of the microcavities away from the electrode 850.

Figure 9:
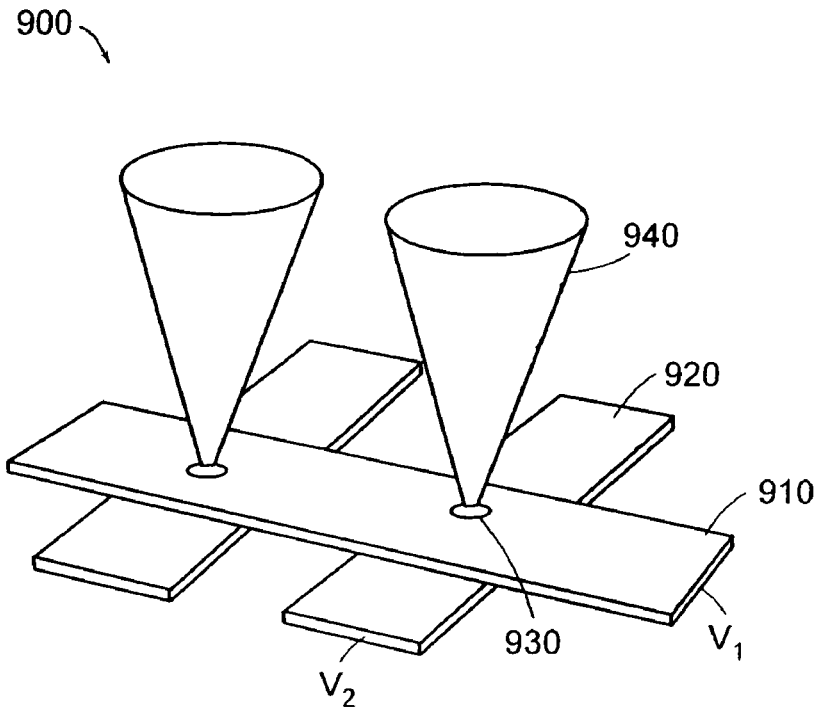
FIG. 9 shows a microdischarge device array for display applications in which the pixels are individually addressable, according to an embodiment of the invention.

In a further embodiment of the invention, as shown in FIG. 9, a microdischarge array 900 can be formed that permits individual microcavities (pixels) to be selectively excited. Pixels 930 of the desired shape can be fabricated in a dielectric-encapsulated electrode 910 of extended length. Below (or above) this first electrode 910 is a second dielectric encapsulated electrode 920 that may also be of extended length. With the application of a voltage $V_1$ to the first electrode 910 and no voltage ($V_2$=0) to the second electrode 920, the pixel at the intersection of the first and second electrodes will not ignite. However, if the proper voltage $V_2$ is also applied to the second electrode, then only the pixel located at the intersection of both electrodes will ignite, emitting light 940. Other pixels in the array will remain dark. In this way, large arrays of pixels, each of which is individually addressable, can be constructed and applied to displays and biomedical diagnostics, for example.

Figure 10:
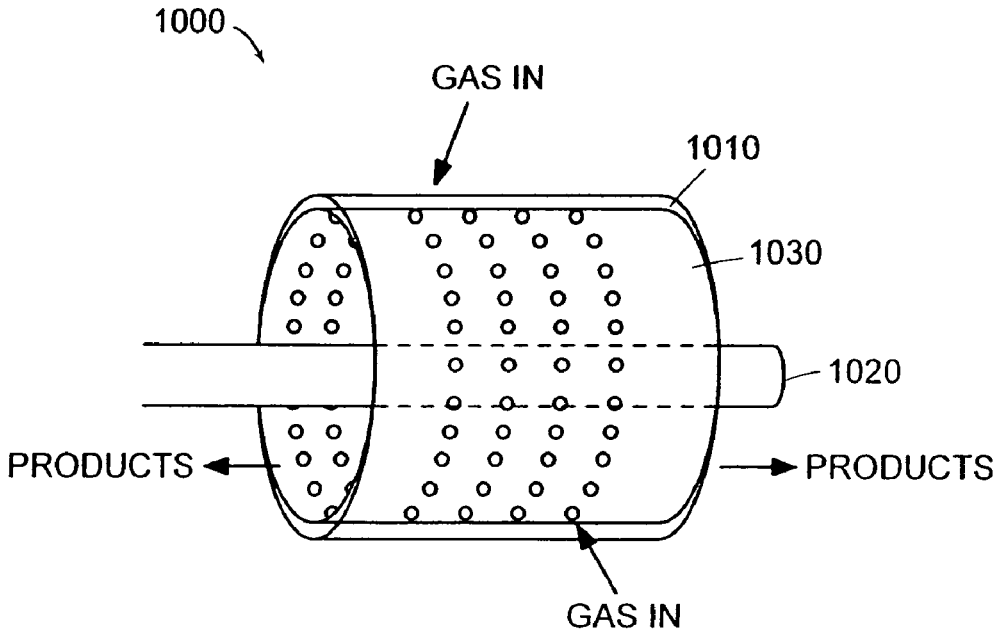
FIG. 10 shows a microdischarge device array formed by a plurality of dielectric-encapsulated microcavities on a cylinder and a center electrode, according to another embodiment of the invention.
Figure 11:
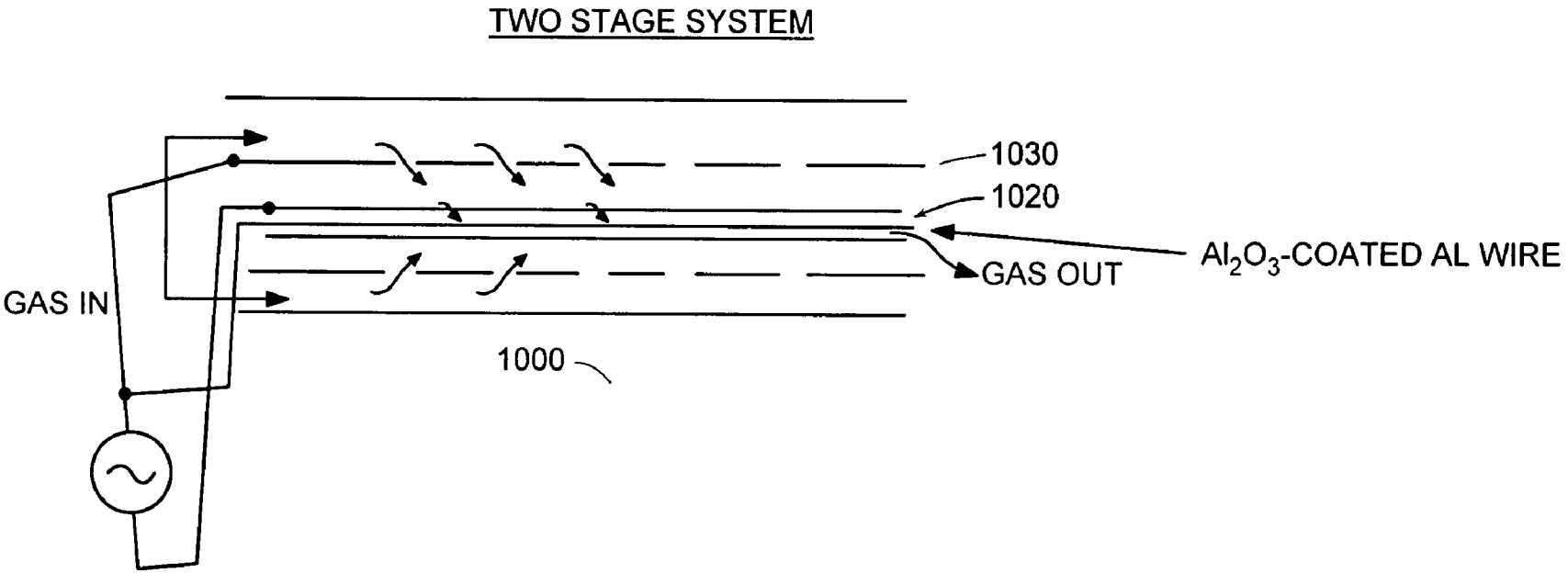
FIG. 11 shows a two stage version of the device of FIG. 10.

The ability to produce nanoporous dielectrics on conducting (e.g., metal) surfaces in any configuration (geometry) may be used to advantage in plasma arrays and processing systems. FIG. 10, for example, illustrates a cylindrical array of microplasma devices 1000 each of which is fabricated on the inside wall of a tubular section 1010 of a metal (foil, film on another surface, aluminum tubing, etc.). After the microcavities have been fabricated in the wall of tube 1010, the array is completed by forming a nanoporous dielectric 1030 on the inner surface of the cylinder 1010 with the dielectric also coating the interior of each microcavity, as described above. Depending on the intended application, the microcavities may be of various shapes and size. For the embodiment of FIG. 10, the microcavities extend through the wall of the cylinder 1010. Gas enters the system from the outside of the cylinder 1010 and passes through the microcavities. If the application of the system is to dissociate (fragment) a toxic or other environmentally-hazardous gas or vapor, passage of the gas through the microdischarges will dissociate some fraction of the undesirable species. If the degree of dissociation in a one stage arrangement is acceptable, the gaseous products can be removed from the system along its axis, as shown in FIG. 10. If the degree of dissociation in one stage is insufficient, then a second stage, concentric with the first stage, may be added, as shown in FIG. 11. In this case, the center electrode 1020 is tubular and an array of microcavities is fabricated in its wall that is similar to that in the tubular section 1010. The microcavities again extend through the wall. Along the axis of the electrode 1020 is a second electrode which may be a tube, rod or wire. Both the first and second electrode are encapsulated by the dielectric. With this two stage system, the gas or vapor of interest is now required to pass through two arrays of microdischarges prior to exiting the system.

As noted earlier, the center electrode 1020, which lies along the axis of the larger cylinder having the microplasma pixels, can be a solid conductor (such as a metal rod or tube) or can alternatively be a transparent conductor deposited onto an optically transparent cylinder (such as quartz tubing). The former design will be of interest for electrically exciting and dissociating gases to produce excited or ground state radicals—whereas the latter will be valuable for photo-exciting a gas or vapor flowing inside the inner (optically transparent) cylinder.

The array of FIG. 10 can be used for photochemical processing such as toxic gas remediation, according to an embodiment of the invention. A time-varying potential is applied between the center electrode 1020 and the cylinder 1030. Another application is optical pumping for amplification of light in a gain medium disposed in the center 1020 of the cylinder.

Several of the devices and arrays described earlier, and those depicted in FIGS. 2, 3, and 5, in particular, have been constructed and tested. A typical microdischarge device fabricated to date consists of Al foil, typically 50-100 microns in thickness, which is first cleaned in an acid solution, and then a microcavity or array of microcavities is micromachined in the foil. The individual microdischarge cavities (i.e., microcavities) are cylindrical with diameters of 50 or 100 microns. After the microcavities are produced, nanoporous $Al/Al_2O_3$ is grown over the entire electrode to a thickness of ~10 microns on the microcavity walls and typically 30-40 microns elsewhere. After assembly of the devices, the devices are evacuated in a vacuum system, de-gassed if necessary, and back-filled with the desired gas or vapor. If desired, the entire device or an array of devices may be sealed in a lightweight package with at least one transparent window by anodic bonding, lamination, glass frit sealing or another process, as is known in the art.

A 2×2 array of $Al/Al_2O_3$ microdischarge devices, each device having a cylindrical microcavity with a 100 micron diameter (device of FIG. 5) has been operated in the rare gases and air. Typical AC operating voltages (values given are peak-to-peak) and RMS currents are 650 V and 2.3 mA for ~700 Torr of Ne, and 800-850 V and 6.25 mA for air. The AC driven frequency for these measurements was 20 kHz. It must be emphasized that stable, uniform discharges were produced in all of the pixels of the arrays without the need for electrical ballast. This result is especially significant for air which has long been known as one of the most challenging gases (or gas mixtures) in which to obtain stable discharges.

Much larger arrays may be constructed and the entire process may be automated. The low cost of the materials required, the ease of device assembly, and the stable well-behaved glow discharges produced in the areas tested to date, all indicate that the microdischarge devices and arrays of embodiments of the present invention can be of value wherever low cost, bright and flexible sources of visible and ultraviolet light are required.

It will, of course, be apparent to those skilled in the art that the present invention is not limited to the aspects of the detailed description set forth above. In any of the described embodiments, the dielectric used to encapsulate an electrode may be a nanoporous dielectric. While aluminum encapsulated with alumina ($Al/Al_2O_3$) has been used as an exemplary material in these devices, a wide variety of materials (e.g., $W/WO_3$) may also be used. Further, in any of the above described embodiments, the microcavities of the device may be filled with a gas at a desired pressure to facilitate microdischarges with particular characteristics. The microcavities may be filled with a discharge gas, such as the atomic rare gases, $N_2$, and the rare gas-halogen donor gas mixtures. Gas pressure and gas mixture composition may be chosen to maintain a favorable number density of the desired radiating species. Various changes and modifications of this invention as described will be apparent to those skilled in the art without departing from the spirit and scope of this invention as defined in the appended claims.

What is claimed is:

1. A microdischarge device comprising:

a first electrode, the first electrode comprising a conductor and a microcavity, the first electrode encapsulated with a first dielectric; and a second electrode, the first and second electrodes configured to ignite a discharge in the microcavity when a time-varying potential is applied between the first and second electrodes.

2. A device according to claim 1, wherein the second electrode is a screen.

3. A device according to claim 2, wherein the second electrode at least partly covers one end of the microcavity.

4. A device according to claim 1, wherein the microcavity is closed at one end.

5. A device according to claim 1, wherein the second electrode comprises a conductor encapsulated with a second dielectric.

6. A device according to claim 5, wherein the second electrode is in direct contact with the first electrode.

7. A device according to claim 5, wherein the second electrode is not in direct contact with the first electrode.

8. A device according to any of claims 1-7, wherein the first dielectric is a nanoporous dielectric.

9. A microdischarge device array comprising:

a plurality of electrode pairs, each electrode pair including a first electrode and a second electrode, each electrode comprising a conductor with a microcavity and encapsulated with a dielectric, the electrodes of each pair configured to ignite a discharge in the microcavity corresponding to that pair when a time-varying potential is applied between the electrodes.

10. An array according to claim 9, wherein the second electrode of a given electrode pair directly contacts the corresponding first electrode of the given pair.

11. An array according to claim 9, wherein no electrode contacts any other electrode.

12. An array according to claim 9, wherein the electrode pairs are stacked such that a linear array of micro cavities is formed.

13. A device according to any of claims 9-12, wherein the dielectric is a nanoporous dielectric.

14. A microdischarge device array comprising:

a planar electrode array including a plurality of metal electrodes encapsulated in a dielectric, the encapsulated planar electrodes including a plurality of microcavities; and a common electrode configured to ignite a discharge in each microcavity when a potential is applied between the common electrode and the electrode array.

15. An array according to claim 14, wherein the common electrode is transparent.

16. An array according to claim 14 wherein the planar electrodes in the array are electrically coupled.

17. A microdischarge device array for display applications comprising:

a plurality of light-emitting electrodes, each light-emitting electrode comprising a conductor with at least one microcavity, each conductor encapsulated with a first dielectric;

an igniting electrode comprising a conductor encapsulated with a second dielectric, the igniting electrode and the light-emitting electrodes configured such that the igniting electrode is associated with a subset of the microcavities contained in the plurality of light-emitting electrodes, the plurality of light-emitting electrodes and the igniting electrode configured such that a microdischarge in a given microcavity in a given light-emitting electrode is ignited only when a time-varying potential above a threshold potential is applied between the given light-emitting electrode and the igniting electrode and the given microcavity is in the subset of microcavities associated with the igniting electrode.

18. An array according to claim 17 wherein at least one of the first dielectric and the second dielectric is a nanoporous dielectric.

19. A cylindrical microdischarge device array comprising:

a metal cylinder, the cylinder characterized by a center axis, a plurality of microcavities formed on the inner surface of the cylinder and encapsulated with a dielectric;

a center electrode disposed along the center axis of the cylinder, the electrode configured to ignite a discharge in each microcavity when a time-varying potential is applied between the center electrode and the cylinder.

20. An array according to claim 19, wherein the center electrode is a transparent electrically-conducting tube.

21. An array according to claim 19, wherein the center electrode is a metal conductor.

22. A method for toxic gas remediation comprising:

providing a microdischarge device array according to claim 19, the microcavities extending through the cylinder wall;

introducing one of a toxic and a hazardous gas to the array by the flowing the gas from one of outside the cylinder and within the cylinder;

applying a time-varying potential between the center electrode and the cylinder to ignite a discharge in each microcavity; and removing a gaseous product from a side of the cylinder wall, the side of the cylinder wall opposite to the side of the cylinder wall from which the one of the toxic gas and hazardous gas was introduced.

* * * * *